US008870526B2

(12) United States Patent
Bryk et al.

(10) Patent No.: US 8,870,526 B2
(45) Date of Patent: Oct. 28, 2014

(54) AXIALLY SEGMENTED GUIDE VANE MOUNT FOR A GAS TURBINE

(75) Inventors: Roderich Bryk, Düren (DE); Sascha Dungs, Wesel (DE); Martin Hartmann, Bochum (DE); Uwe Kahlstorf, Mülheim a.d. Ruhr (DE); Karl Klein, Essen (DE); Oliver Lüsebrink, Witten (DE); Mirko Milazar, Oberhausen (DE); Nicolas Savilius, Essen (DE); Oliver Schneider, Wesel (DE); Shilun Sheng, Oberhausen (DE); Vadim Shevchenko, Dortmund (DE); Gerhard Simon, Essen (DE); Norbert Thamm, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 609 days.

(21) Appl. No.: 13/127,295

(22) PCT Filed: Sep. 10, 2009

(86) PCT No.: PCT/EP2009/061744
§ 371 (c)(1),
(2), (4) Date: Jul. 19, 2011

(87) PCT Pub. No.: WO2010/052050
PCT Pub. Date: May 14, 2010

(65) Prior Publication Data

US 2011/0268580 A1 Nov. 3, 2011

(30) Foreign Application Priority Data

Nov. 5, 2008 (EP) ..... 08019365

(51) Int. Cl.
*F01D 25/24* (2006.01)
*F01D 9/04* (2006.01)

(52) U.S. Cl.
CPC ..... *F01D 9/041* (2013.01); *F01D 25/246* (2013.01)
USPC ..... 415/116

(58) Field of Classification Search
USPC ..... 415/191, 199.1, 199.2, 199.4, 199.5, 415/200, 208.1, 208.2, 209.1, 209.2, 209.3, 415/209.4, 210.1, 211.1, 175, 179, 134, 137
See application file for complete search history.

(56) References Cited

U.S. PATENT DOCUMENTS 3,304,054 A 2/1967 Moser
3,408,044 A 10/1968 Burger (Continued)

FOREIGN PATENT DOCUMENTS

CH 417637 A 7/1966
GB 1051244 A 12/1966

(Continued)

OTHER PUBLICATIONS

Ischlinsky, "Gas-Dampf-Turbinenanlagen", Das neue Polytechnische Lexikon, Enzyklopedia p. 361, 2000, RU.

*Primary Examiner* — Edward Look
*Assistant Examiner* — Eldon Brockman

(57) ABSTRACT

A stator blade carrier for a gas turbine is provided. The stator blade carrier includes a plurality of axial segments. At least one axial segment is designed as a tubular lattice structure. This allows a simpler design technically and a more flexible adaptation to the temperature profile present on the stator blade carrier to maintain operational safety.

8 Claims, 2 Drawing Sheets

(56) References Cited

U.S. PATENT DOCUMENTS

| | | | | |
|---|---|---|---|---|
| 3,742,705 | A * | 7/1973 | Sifford | 60/806 |
| 4,318,666 | A * | 3/1982 | Pask | 415/116 |
| 4,826,397 | A * | 5/1989 | Shook et al. | 415/116 |
| 4,920,742 | A * | 5/1990 | Nash et al. | 60/799 |
| 5,193,982 | A * | 3/1993 | Inizan et al. | 416/193 A |
| 5,314,303 | A * | 5/1994 | Charbonnel et al. | 415/173.1 |
| 5,391,052 | A * | 2/1995 | Correia et al. | 415/115 |
| 6,089,821 | A * | 7/2000 | Maguire et al. | 415/115 |
| 6,179,560 | B1 * | 1/2001 | Kouris et al. | 415/190 |
| 6,514,041 | B1 * | 2/2003 | Matheny et al. | 415/177 |
| 6,575,699 | B1 * | 6/2003 | Jones | 415/200 |
| 7,070,387 | B2 * | 7/2006 | Crozet et al. | 415/173.1 |
| 7,524,164 | B2 * | 4/2009 | Wunderlich et al. | 415/136 |
| 7,798,775 | B2 * | 9/2010 | Kammel et al. | 415/209.3 |
| 8,100,644 | B2 * | 1/2012 | Hazevis et al. | 415/209.3 |
| 8,137,056 | B2 * | 3/2012 | Fujimoto et al. | 415/116 |
| 8,475,118 | B2 * | 7/2013 | Mulcaire et al. | 415/134 |
| 2004/0184912 | A1 * | 9/2004 | Crozet et al. | 415/191 |
| 2005/0022501 | A1 * | 2/2005 | Eleftheriou et al. | 60/226.1 |
| 2005/0254939 | A1 * | 11/2005 | Wunderlich et al. | 415/170.1 |
| 2006/0159549 | A1 * | 7/2006 | Durocher et al. | 415/170.1 |

FOREIGN PATENT DOCUMENTS

| | | | |
|---|---|---|---|
| GB | 417637 | A | 2/2003 |
| GB | 2378730 | A | 2/2003 |
| JP | 11036809 | A | 2/1999 |
| JP | 2002364307 | A | 12/2002 |
| JP | 2008516144 | A | 5/2008 |
| SU | 550484 | A1 | 3/1977 |
| SU | 1263777 | A1 | 10/1986 |
| WO | WO 2005008032 | A1 | 1/2005 |

* cited by examiner

AXIALLY SEGMENTED GUIDE VANE MOUNT FOR A GAS TURBINE

CROSS REFERENCE TO RELATED APPLICATIONS

This application is the US National Stage of International Application No. PCT/EP2009/061744 filed Sep. 10, 2009 and claims the benefit thereof. The International Application claims the benefits of European application No. 08019365.9 EP filed Nov. 5, 2008. All of the applications are incorporated by reference herein in their entirety.

FIELD OF INVENTION

The invention refers to a stator blade carrier—especially for a gas turbine—which consists of a number of axial segments.

BACKGROUND OF INVENTION

Gas turbines are used in many fields for driving generators or driven machines. In this case, the energy content of a fuel is used for producing a rotational movement of a turbine shaft. For this, the fuel is combusted in a combustion chamber, wherein compressed air is fed from an air compressor. The operating medium, under high pressure and under high temperature, which is produced in the combustion chamber as a result of combusting the fuel is directed in this case through a turbine unit, which is connected downstream to the combustion chamber, where it expands, performing work.

For producing the rotational movement of the turbine shaft, in this case a number of rotor blades, which customarily are assembled into blade groups or blade rows and drive the turbine shaft via an impulse transfer from the operating medium, are arranged on this turbine shaft. For flow guiding of the operating medium in the turbine unit, moreover, stator blades, which are connected to the turbine casing and assembled to form stator blade rows, are customarily arranged between adjacent rotor blade rows.

The combustion chamber of the gas turbine can be constructed as a so-called annular combustion chamber, in which a multiplicity of burners, which are arranged around the turbine shaft in the circumferential direction, lead into a common combustion chamber space which is enclosed by a high-temperature-resistant surrounding wall. For this, the combustion chamber in its entirety is designed as an annular structure. In addition to a single combustion chamber, provision may also be made for a multiplicity of combustion chambers.

A first stator blade row of a turbine unit as a rule directly adjoins the combustion chamber and together with the directly following rotor blade row, as seen in the flow direction of the operating medium, forms a first turbine stage of the turbine unit to which further turbine stages are customarily connected downstream.

The stator blades in this case are fixed in each case on a stator blade carrier of the turbine unit via a blade root which is also referred to as a platform. In this case, the stator blade carrier can comprise an insulating segment for fastening the platforms of the stator blades. Between the platforms—which are arranged in a spaced apart manner in the axial direction of the gas turbine—of the stator blades of two adjacent stator blade rows, a guide ring is arranged in each case on the stator blade carrier of the turbine unit. Such a guide ring, by means of a radial gap, is at a distance from the blade tips of the rotor blades of the associated rotor blade row which are fixed on the turbine shaft at the same axial position. As a result, the platforms of the stator blades and the guide rings, which in turn are possibly of a segmented construction in the circumferential direction of the gas turbine, form a number of wall elements of the turbine unit, constituting the outer limit of a flow passage for the operating medium.

SUMMARY OF INVENTION

In the design of such gas turbines, in addition to the achievable output, a particularly high efficiency is customarily a design aim. An increase of the efficiency in this case can be achieved, for thermodynamic reasons, basically by increasing the exit temperature at which the operating medium flows out of the combustion chamber and flows into the turbine unit. Therefore, temperatures of about 1200° C. to 1500° C. are aimed at and also achieved for such gas turbines.

With such high temperatures of the operating medium, however, the components and parts which are exposed to this are subjected to high thermal loads. Therefore, particularly the stator blade carrier of the gas turbine is customarily produced from cast steel. This is suitable for withstanding the high temperatures inside the gas turbine and therefore reliable operation of the gas turbine can be ensured.

Depending upon the design aim of the gas turbine, the stator blades of the gas turbine in this case can be fastened either on a common stator blade carrier or provision is made for separate axial segments for each turbine stage, as in GB 1 051 244 A, for example. In any case, at least in the case of large gas turbines, however, the result is one or more very large cast part(s) which requires, or require, a correspondingly cost-intensive and technically costly construction. Furthermore, the entire turbine stator blade carrier is not exposed to the extremely high temperatures which require a high heat-resistant cast steel, but there is a temperature profile which has comparatively small regions with high temperatures and also a larger, rear region with low temperatures.

The invention is therefore based on the object of disclosing a stator blade carrier which allows a technically simpler construction and more flexible adaptation to the temperature profile which prevails on the stator blade carrier, while maintaining operational reliability.

This object is achieved according to the invention by at least one axial segment being designed as a tubular lattice structure.

The invention starts in this case from the consideration that a more flexible adaptation to the temperature profile inside the gas turbine in the region of the stator blade carrier could be created especially as a result of different materials of the individual axial segments of the stator blade carrier. In this case, high temperatures occur, especially in the region of the hook-fastening of the stator blades and of the ring segments since these components create a local heat transfer in the region of their fastening. Furthermore, the most forward region of the stator blade carrier is exposed to comparatively high compressor exit temperature. At these points, a relatively high-quality material is necessary from the thermal point of view. For large regions of the turbine carrier, the temperature resistance of this material is not necessary, however. These regions could consist of more favorable and less costly material. In order to furthermore reduce the weight of the stator blade carrier and so enable a simpler construction of the gas turbine, the axial segments in the regions of low temperature should furthermore not be solidly constructed. Therefore, these axial segments should be formed as a lattice structure with a multiplicity of tubes, bars, rods, beams, profiles and the like, i.e. as interconnected struts arranged in the style of a tubular lattice structure.

In an advantageous development, the respective lattice structure is provided with a metal casing on its inner and/or outer side. With this, a particularly simple construction of the stator blade carrier is possible. The development with a metal-encased tubular lattice construction can replace sections of the stator blade carrier provided up to now as cast parts by a simpler structure without jeopardizing the operational reliability of the gas turbine in the process. At the same time, a smaller amount of material is therefore required.

The respective metal casing advantageously has cooling air holes. Through these holes passes secondary air, with which an especially simple and reliable cooling of the inner side—produced from metal—of the stator blade carrier is ensured. These holes, moreover, are simpler to produce than the cooling air holes which are required in cast parts, as a result of which by increasing the number of holes, with the same cross section or flow resistance, a finer distribution to the subsequent ring segments can also be provided.

In a further advantageous development, the material of the respective axial segment and/or, if applicable, of the respective metal casing is adapted to the local thermal and mechanical loads which are envisaged during operation. As a result of such adaptation, an accurate matching of the material used in each case for the cast parts and/or for the metal casings to the respective local temperature and power conditions is ensured. Regions subjected to particularly high temperatures should be produced from a particularly high-quality and heat-resistant material, whereas in the cooler regions of the stator blade carrier comparatively more favorable material can be used.

A number of axial segments are advantageously welded to each other. As a result of welding the individual axial segments, i.e. the individual tubular lattice structures and the axial segments which are produced as cast parts, a geometrically stable and secure connection is ensured.

In a further advantageous development, all the axial segments are designed as a tubular lattice structure. For a very especially simple construction of a stator blade carrier, namely the entire stator blade carrier can be formed as a tubular lattice structure, wherein, if applicable, segment-wise different metal casings are used on the inner side. As a result, an even simpler construction of the stator blade carrier and therefore of the gas turbine is possible.

A gas turbine advantageously comprises such a stator blade carrier, and a gas and steam turbine plant comprises a gas turbine with such a stator blade carrier.

The advantages which are associated with the invention are especially that as a result of the design of an axial segment of a stator blade carrier as a tubular lattice structure, a technically significantly simpler, lighter and more cost-effective construction of a stator blade carrier and therefore of the entire gas turbine becomes possible. In particular, more favorable materials can be used in the regions with lower temperature impact and cost-intensive high-temperature materials stay limited to the front, hot region of the gas turbine. Furthermore, the remaining axial segments which are produced from cast parts are comparatively smaller, as a result of which a simpler construction of the stator blade carrier and of the entire gas turbine becomes possible.

Since the tubular lattice structure is poorer in heat conductivity than a solid cast part, a lower conduction of heat in the axial direction takes place, moreover, especially from the hot regions at the compressor exit to the rear, cooler regions, as a result of which improved cooling of the stator blade carrier and consequently a lower axial, and possibly also radial, thermal expansion are achieved. As a result, this construction shows great potential for stator blade carriers which are to be further developed since thermal and mechanical requirements can be met in a more flexible manner. In the front region of the turbine stator blade carrier there are exceedingly high requirements for maintaining the gaps to the stator blades and rotor blades in order to ensure the turbine efficiency. With segmenting by means of the tubular lattice construction, the thermal expansion behavior can be established to a very much better degree than previously and therefore the required minimum gap can be made smaller.

BRIEF DESCRIPTION OF THE DRAWINGS

An exemplary embodiment of the invention is explained in more detail with reference to a drawing. In the drawing.

DETAILED DESCRIPTION OF INVENTION

Like parts are provided with the same designations in all the figures.

Figure 1:
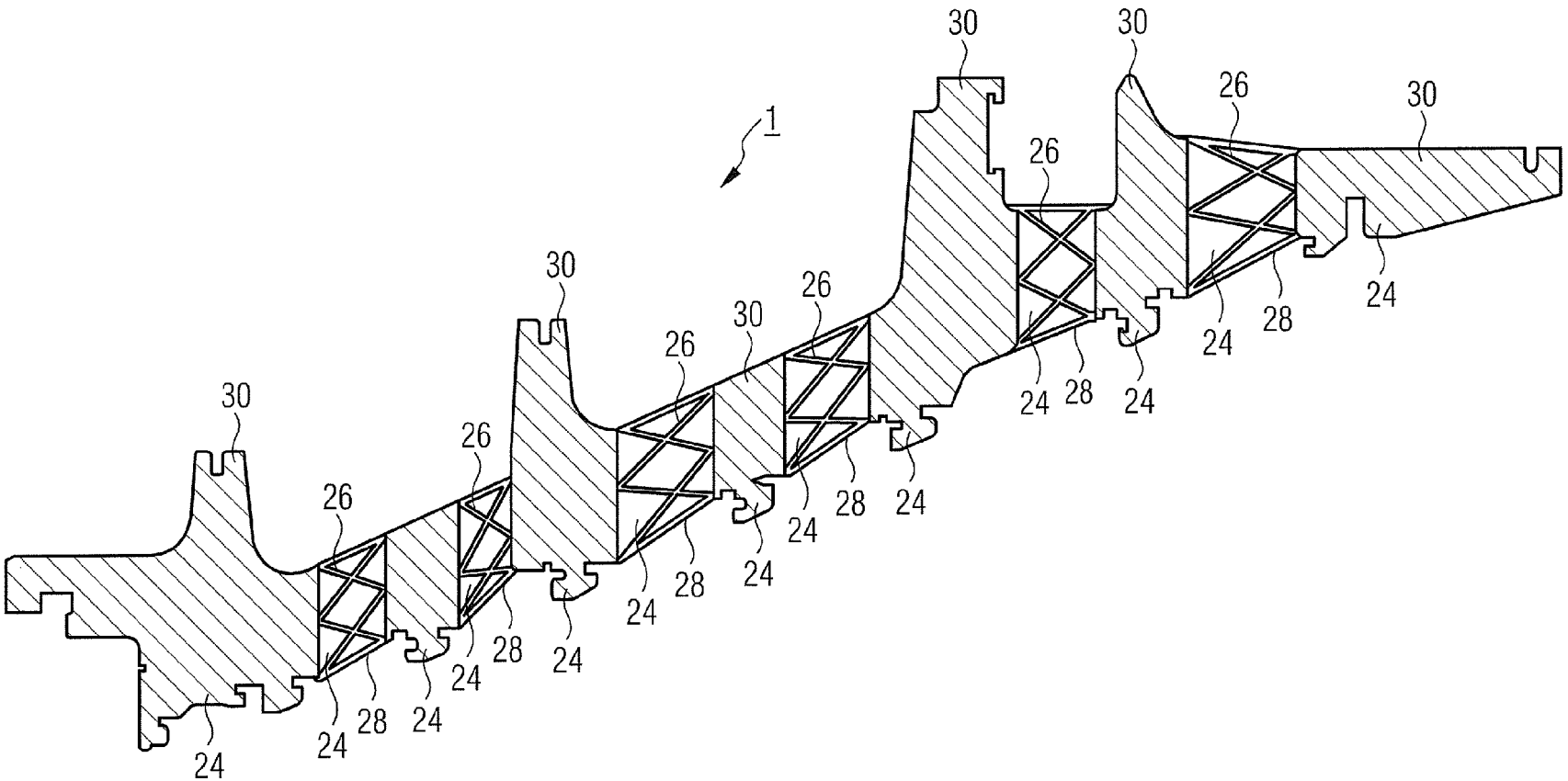
FIG. 1 shows a half-section through the upper half of a stator blade carrier which consists of a number of axial segments.

FIG. 1 shows in detail a half-section through a stator blade carrier 1. In stationary gas turbines, the stator blade carrier 1 is customarily formed conically or cylindrically and consists of two segments, being an upper segment and a lower segment, which are interconnected via flanges, for example. In this case, only the section through the upper segment is shown.

The stator blade carrier 1 which is shown comprises a number of axial segments 24 which are welded to each other for forming a rigid structure. In order to enable a simpler and lighter construction of the stator blade carrier 1, which, moreover, can be flexibly adapted to the temperature conditions inside the gas turbine 101, a number of axial segments 24 of the stator blade carrier 1 are designed as a lattice construction 26, also referred to as a lattice structure. The lattice constructions 26 are provided in each case on their inner side with a metal casing 28. The struts of the lattice construction can be formed with the widest variety of profiles, such as round, square, or even as hollow bodies or in solid constructional form.

The remaining axial segments 24 are formed as cast parts 30. In this case, the material of the cast parts 30 and of the metal casings 28 is adapted in each case to the thermal conditions in their respective region inside the gas turbine. Alternatively to the figure which is shown, a complete construction of the stator blade carrier 1 consisting of lattice segments would also be possible.

Figure 2:
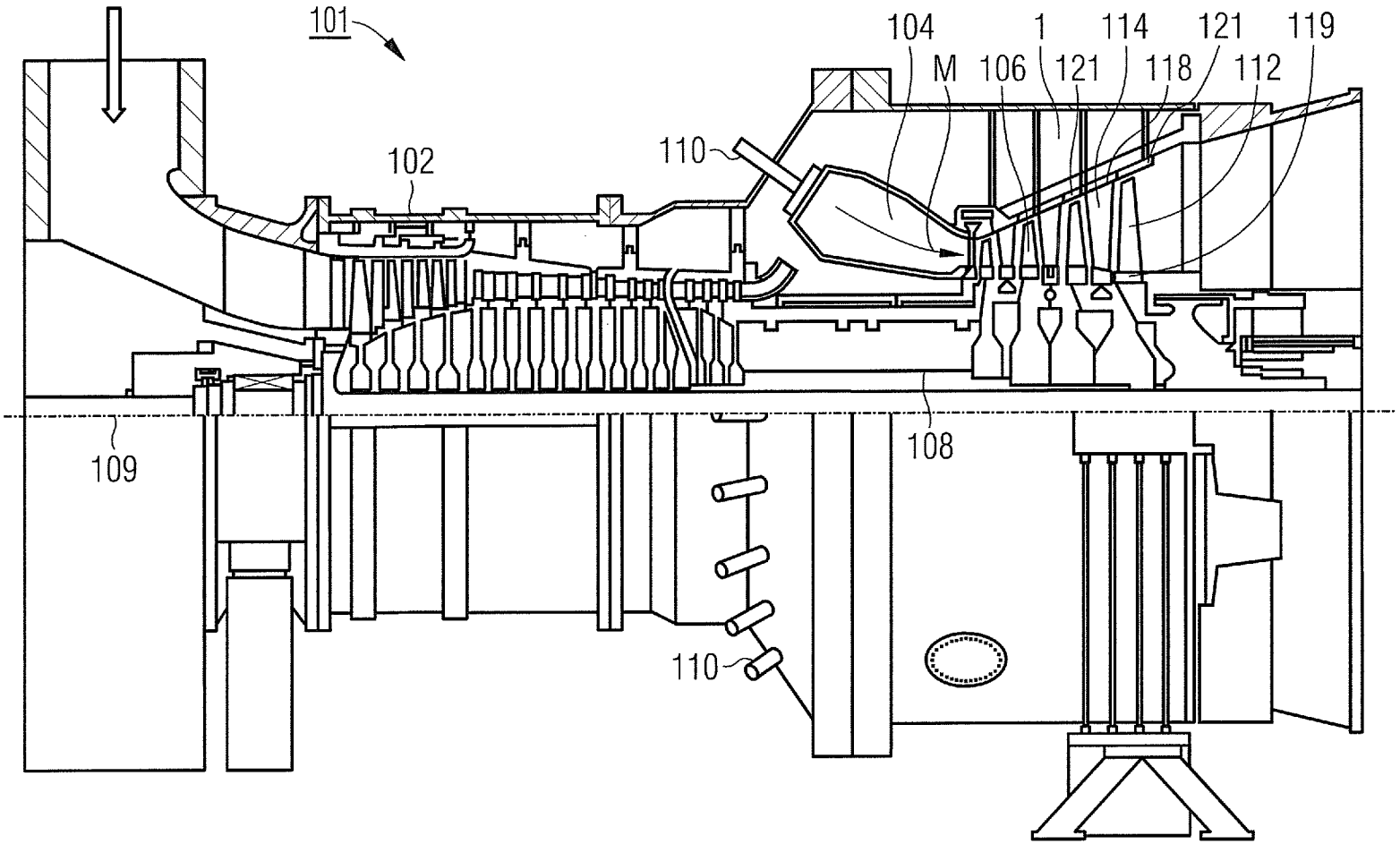
FIG. 2 shows a half-section through a gas turbine.

The gas turbine 101 according to FIG. 2 has a compressor 102 for combustion air, a combustion chamber 104 and also a turbine unit 106 for driving the compressor 102 and for a generator or a driven machine, which is not shown. In addition, the turbine unit 106 and the compressor 102 are arranged on a common turbine shaft 108 which is also referred to as a turbine rotor to which the generator or the driven machine is also connected, and which is rotatably mounted around its center axis 109. The combustion chamber 104 which is constructed in the style of an annular combustion chamber is equipped with a number of burners 110 for combusting a liquid or gaseous fuel.

The turbine unit 106 has a number of rotatable rotor blades 112 which are connected to the turbine shaft 108. The rotor blades 112 are arranged on the turbine shaft 108 in a ring-like manner and therefore form a number of rotor blade rows. Furthermore, the turbine unit 106 comprises a number of fixed stator blades 114 which are also fastened in a ring-like manner on a stator blade carrier 1 of the turbine unit 106, forming stator blade rows. The rotor blades 112 in this case serve for driving the turbine shaft 108 as a result of impulse transfer from the operating medium M which flows through the turbine unit 106. The stator blades 114 on the other hand serve for flow guiding of the operating medium M between two consecutive rotor blade rows or rotor blade rings in each case, as seen in the flow direction of the operating medium M. A consecutive pair, consisting of a ring of stator blades 114 or a stator blade row and a ring of rotor blades 112 or a rotor blade row, in this case is also referred to as a turbine stage.

Each stator blade 114 has a platform 118 which, for fixing of the respective stator blade 114 on a stator blade carrier 1 of the turbine unit 106, is arranged as a wall element. The platform 118 in this case is a thermally comparatively heavily loaded component which forms the outer limit of a hot gas passage for the operating medium M which flows through the turbine unit 106. Each rotor blade 112 is fastened in a similar way on the turbine shaft 108 via a platform 119 which is also referred to as a blade root.

Between the platforms 118—which are arranged in a spaced apart manner—of the stator blades 114 of two adjacent stator blade rows, a guide ring 121 is arranged in each case on a stator blade carrier 1 of the turbine unit 106. The outer surface of each guide ring 121 in this case is also exposed to the hot operating medium M which flows through the turbine unit 106 and in the radial direction, as a result of a gap, is at a distance from the outer end of the rotor blades 112 which lie opposite it. The guide rings 121 which are arranged between adjacent stator blade rows in this case especially serve as cover elements which protect the inner casing in the stator blade carrier 1 or other installed components of the casing against thermal overstress as a result of the hot operating medium M which flows through the turbine 106.

The combustion chamber 104 in the exemplary embodiment is designed as a so-called annular combustion chamber in which a multiplicity of burners 110, which are arranged around the turbine shaft 108 in the circumferential direction, lead into a common combustion chamber space. For this, the combustion chamber 104 in its entirety is designed as an annular structure which is positioned around the turbine shaft 108.

By using a stator blade carrier 1 of the design which is specified above, optimum matching of the material to the temperature conditions inside the gas turbine 101 is ensured. Parts which lie closer to the compressor, which are exposed to a correspondingly higher temperature, i.e. the axial segments 24 which in FIG. 2 lie furthest to the left, are correspondingly produced from a more high-temperature-resistant material than in the regions which are connected downstream in the gas passage. As a result of the lattice structure, a good thermal insulation of the individual cast parts 30 from each other is furthermore ensured, as a result of which thermal deformations can be minimized.

The invention claimed is:

1. A stator blade carrier for a gas turbine, comprising:

a plurality of axial segments for carrying a plurality of rows of stator guide vanes in a ring shaped arrangement, wherein at least one axial segment is designed as a tubular lattice structure, wherein the tubular lattice structure of the at least one axial segment is provided with a metal casing on its inner side, or on its outer side, or on both inner and outer sides, wherein the metal casing comprises cooling air holes.

2. The stator blade carrier as claimed in claim 1, wherein the at least one axial segment is made of a material adapted to withstand local thermal and mechanical loads during operation.

3. The stator blade carrier as claimed in claim 1, wherein the metal casing is made of a material adapted to withstand local thermal and mechanical loads during operation.

4. The stator blade carrier as claimed in claim 1, wherein the plurality of axial segments are welded to each other.

5. The stator blade carrier as claimed in claim 1, wherein each of the plurality of axial segments is designed as a tubular lattice structure.

6. The stator blade carrier as claimed in claim 1, wherein the lattice structure comprises a plurality of interconnected crossed struts.

7. A gas turbine, comprising:

a stator blade carrier comprising a plurality of axial segments that carry a plurality of rows of stator guide vanes in a ring-shaped arrangement, wherein at least one axial segment is designed as a tubular lattice structure, wherein the tubular lattice structure of the at least one axial segment is provided with a metal casing on its inner side, or on its outer side, or on both inner and outer sides, wherein the metal casing comprises cooling air holes.

8. A gas and steam turbine plant, comprising:

a gas turbine, comprising:

a stator blade carrier comprising a plurality of axial segments for carrying a plurality of rows of stator guide vanes in a ring-shaped arrangement, wherein at least one axial segment is designed as a tubular lattice structure, wherein the tubular lattice structure of the at least one axial segment is provided with a metal casing on its inner side, or on its outer side, or on both inner and outer sides, wherein the metal casing comprises cooling air holes.

* * * * *